US008162194B2

(12) United States Patent
Gleason

(10) Patent No.: US 8,162,194 B2
(45) Date of Patent: Apr. 24, 2012

(54) BACKPACK WITH SIDE BOLSTERS

(75) Inventor: Dana Gleason, Bozeman, MT (US)

(73) Assignee: Mystery Ranch, Bozeman, MT (US)

( * ) Notice: Subject to any disclaimer, the term of this patent is extended or adjusted under 35 U.S.C. 154(b) by 861 days.

(21) Appl. No.: 12/032,541

(22) Filed: Feb. 15, 2008

(65) Prior Publication Data

US 2009/0206115 A1 Aug. 20, 2009

(51) Int. Cl.
*A45F 3/00* (2006.01)

(52) U.S. Cl. ..... 224/628; 224/644; 224/637; 224/633

(58) Field of Classification Search ..... 224/642, 224/644, 650–652, 153, 627–630, 633, 645
See application file for complete search history.

(56) References Cited

U.S. PATENT DOCUMENTS

| | | | | |
|---|---|---|---|---|
| 2,953,793 | A * | 9/1960 | Rossi | 5/705 |
| 3,206,087 | A * | 9/1965 | Tyrreli | 224/636 |
| 3,622,056 | A * | 11/1971 | Droeger | 224/153 |
| 4,324,012 | A | 4/1982 | Cannaday | |
| 4,713,854 | A | 12/1987 | Graebe | |
| 5,890,640 | A | 4/1999 | Thompson | |
| 6,592,012 | B2 | 7/2003 | Godshaw et al. | |
| 2004/0134955 | A1 | 7/2004 | Williams | |
| 2004/0244115 | A1 * | 12/2004 | Adams et al. | 5/636 |
| 2004/0262355 | A1 | 12/2004 | Meyer | |
| 2005/0205634 | A1 | 9/2005 | Han | |

FOREIGN PATENT DOCUMENTS

| | | |
|---|---|---|
| JP | 09094116 | 4/1997 |
| JP | 09252840 | 9/1997 |
| JP | 10014657 | 1/1998 |
| JP | 2000152819 | 6/2000 |
| JP | 2006122543 | 5/2006 |

* cited by examiner

*Primary Examiner* — Justin Larson
*Assistant Examiner* — Corey Skurdal
(74) *Attorney, Agent, or Firm* — Lowe Graham Jones PLLC

(57) ABSTRACT

A backpack includes a stabilizing and ventilating side bolster assembly coupled to a frame. The side bolster assembly includes breathable side bolsters received in breathable sleeves that cooperate with the frame to stabilize the backpack under load while providing improved ventilation between the backpack and a back side of a wearer of the backpack. The side bolsters may be customized for a particular environment, for a particular body type, or for particular loads to be carried in the backpack by changing the stiffness, density, material, dimensions or other aspects of the side bolsters.

18 Claims, 6 Drawing Sheets

BACKPACK WITH SIDE BOLSTERS

FIELD OF THE INVENTION

This invention relates generally to a backpack with side bolsters and, more specifically, to side bolsters for stabilizing the backpack and providing ventilation between the backpack and a wearer of the backpack.

BACKGROUND OF THE INVENTION

Conventional backpacks are generally configured with either an internal or external frame coupled to a compartment for carrying gear, such as, but not limited to clothing, food, water bottles and sleeping gear. Internal frame backpacks are generally more stable, but the weight or load of the gear in the load compartment should be selectively distributed to help improve the vertical and rotational stability of the backpack relative to a wearer. By way of example, one type of conventional internal frame backpack includes flexible stays arranged within frame material. The flexible stays may be arranged vertically, horizontally, or in some other direction in an attempt to transfer the load in the load compartment to the shoulder straps and the waist belt of the backpack.

Stabilizing the backpack on the wearer, maintaining a desired amount of ventilation between the backpack and the wearer, and providing a comfortable fit after the backpack has been loaded and strapped onto the wearer has always been some of the primary challenges in designing and configuring a backpack. In some environments, where heavy backpack loads are required or where the backpack is to be worn with other gear, such as body armor in a military environment, the above-identified design challenges become even more difficult to overcome. By way of example, backside armor is generally curved or contoured to at least somewhat conform to the general shape of a soldier's back. Conventional backpacks tend to ride on and slide relative to the backside armor. Under heavy load conditions, such as when the backpack includes a substantial amount of weight (e.g., food, clothing, ammunition, communications gear, etc.), the backpack may become unstable relative to the backside armor. To stabilize the backpack, soldier's often have to highly tighten the waist belt, which in turn presses the backside armor into the soldier's back and entraps body heat.

U.S. Patent Publication No. 2005/02025634 to Han describes cushion pads for backpacks. Each cushion pad includes a porous filter which is placed inside the net fabric to dissipate heat to the atmosphere, and a sheet which is made of a material such as polyurethane and layered on a surface of the porous filter. The sheet is inserted along with the porous filter into a space defined between the net fabric and the cloth of the backpack. Han suggests that the cushion pads provide improved ventilation and elasticity to the backpack and the shoulder straps of the backpack.

U.S. Patent Publication No. 2004/0134955 to Williams describes a ventilation system that may be attached to a conventional backpack. The ventilation system elevates the backpack, hydration pack, fanny pack, or the like off the wearer's skin. The ventilation system includes pliable supports that provide for pressure relief and good ventilation between a wearer's back and the conventional backpack. Williams suggests that the purpose of the invention is to support and elevate the backpack off of the wearer's skin or other bodily part in order to reduce the pack's surface area in contact with the wearer, thusly increasing ventilation and exposed wearer's body surface area to maximize cooling, therefore reducing perspiration and water consumption, while increasing performance, comfort, and physical and mental endurance.

Japanese Patent No. JP09252840 by Shigeharu describes a back panel and cushioning system that includes a back panel that couples to the backpack. The back panel substantially over a width of the wearer's back and includes left and right edges that are curved in a direction away from the back. Cushioning devices are coupled to the left and right edges and generally extend from an upper edge to a lower edge of the back panel. Shigeharu suggests that the space created between the back panel and the wearer's back because the cushioning devices offset the backpack from the wearer's back provides improved ventilation.

SUMMARY OF THE INVENTION

The present invention generally relates to a backpack having stabilizing and ventilating side bolsters coupled to a frame. The side bolsters may be located or received in breathable sleeves coupled to the backpack. The side bolsters function to cooperate with the frame and stabilize the backpack under load while providing improved ventilation between the backpack and a back side of a wearer of the backpack. By way of example, the side bolsters may be customized for a particular environment, for a particular body type, or for particular loads to be carried in the backpack. For example, the side bolsters may be configured with a variable stiffness by controlling the size, material, density, and other aspects of the side bolsters.

In accordance with an aspect of the invention, a backpack includes a frame; a load compartment coupled to the frame; shoulder straps coupled to the frame; and a side bolster assembly includes a cylindrically-shaped, rolled member located within a sleeve, the cylindrically-shaped, rolled member is made from a first breathable material, the sleeve is made from a second breathable material and coupled to the backpack, the side bolster cooperating with the sleeve to allow air flow through side bolster assembly and further arranged to provide a desired amount of stability for the backpack.

In accordance with another aspect of the invention, a stabilizing system for a backpack includes a cylindrically-shaped, rolled member made from a woven synthetic material; and a sleeve coupled to the backpack and sized to receive the cylindrically-shaped, rolled member, the sleeve made from a breathable material, wherein the cylindrically-shaped, rolled member is arranged in the sleeve to provide an amount of vertical stabilization to the backpack, and wherein the cylindrically-shaped, rolled member cooperates with the sleeve to move air through the cylindrically-shaped, rolled member and through the sleeve in at least a first direction.

BRIEF DESCRIPTION OF THE DRAWINGS

Preferred and alternative embodiments of the present invention are described in detail below with reference to the following drawings.

DETAILED DESCRIPTION OF THE PREFERRED EMBODIMENT

In the following description, certain specific details are set forth in order to provide a thorough understanding of various embodiments of the invention. However, one skilled in the art will understand that the invention may be practiced without these details or with various combinations of these details. In other instances, well-known structures and methods associated with backpacks, backpack frames, shoulder and waist harness systems, and various other accessory items usable with a backpack may not be shown or described in detail to avoid unnecessarily obscuring descriptions of the embodiments of the invention. The term backpack as used herein generally refers to a soft-covered carrier designed for carrying belongings or items on a person's back within the carrier. In addition, the term backpack, as used herein, includes, but is not limited to, carriers that may be referred to by other names such as a rucksack, knapsack, pack, carrier, bag, and daypack.

As will be described in further detail below, at least one embodiment of the invention includes a backpack having stabilizing and ventilating side bolsters coupled to a frame. The backpack may be configured to operate in a variety of environments such as a in the military, on a climbing, hiking or camping trip, or for general traveling. The side bolsters function to cooperate with the frame and stabilize the backpack under load while providing improved ventilation between the backpack and a back side of a wearer of the backpack. Stabilizing the backpack includes reducing or even preventing bulging when the backpack is under load. By way of example, the side bolsters may be customized for a particular environment, for a particular body type, or for particular loads to be carried in the backpack.

Figure 1:
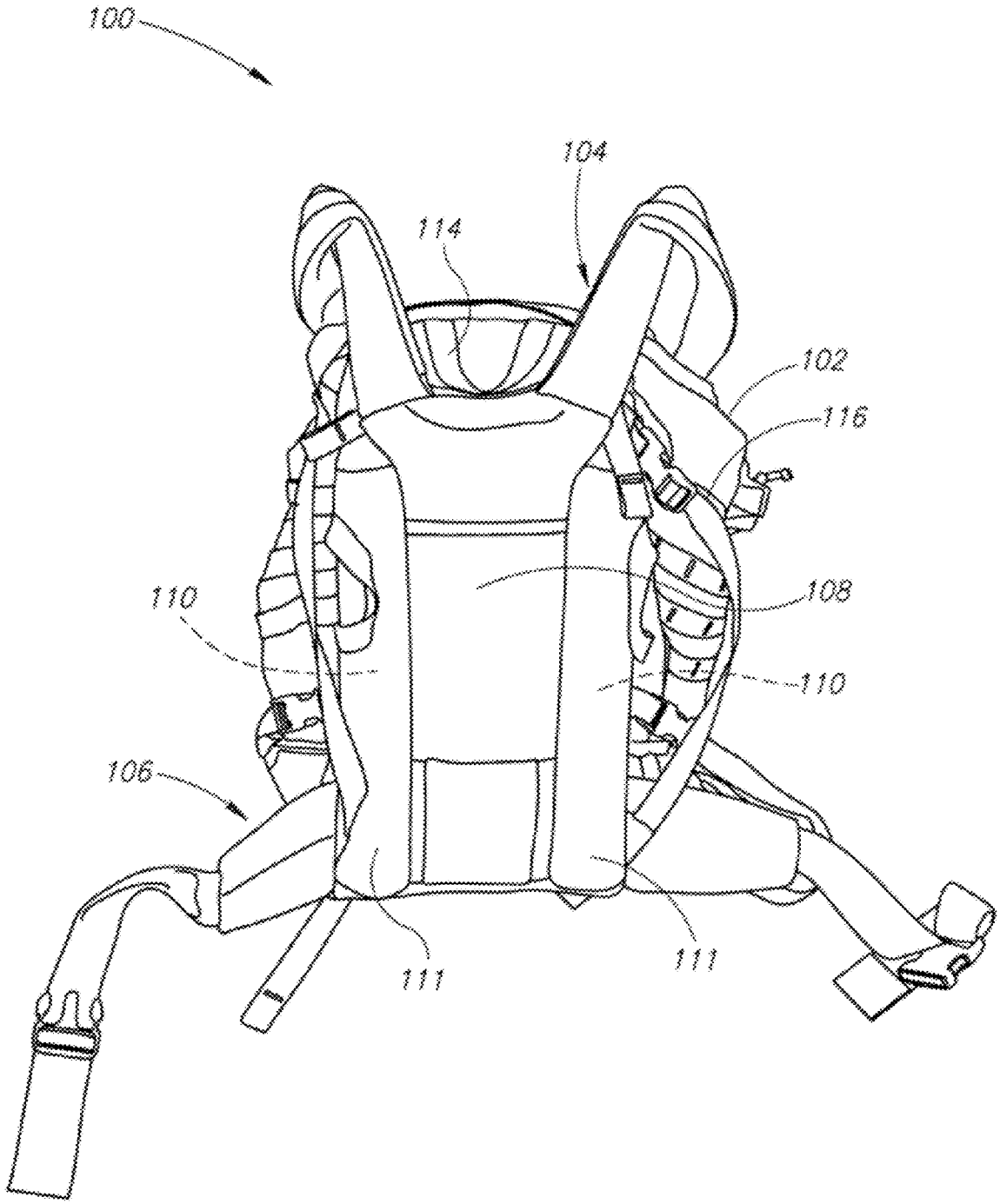
FIG. 1 is a rear elevational view of a backpack with a side bolster assembly according to an illustrated embodiment of the present invention.
Figure 2:
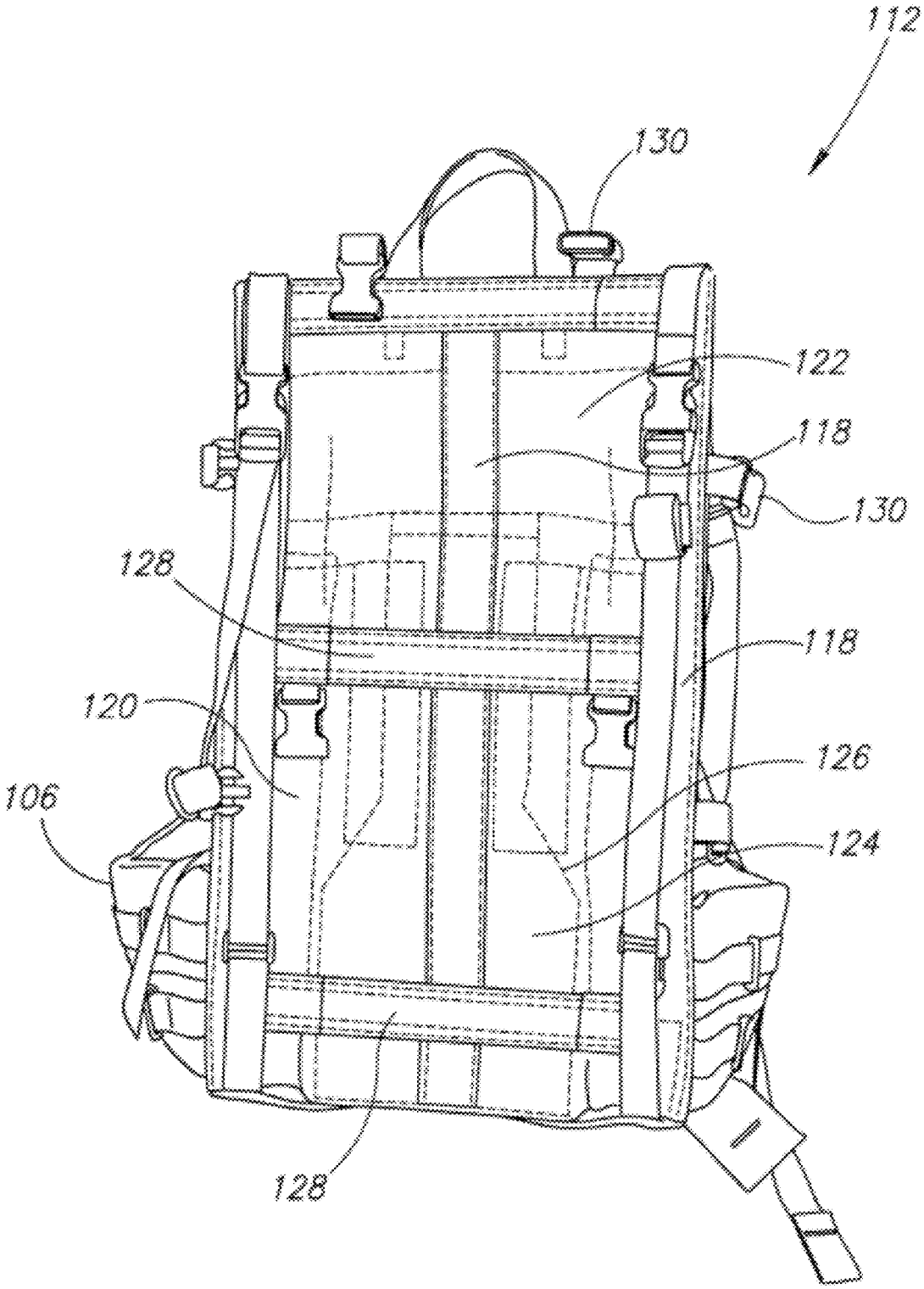
FIG. 2 is rear elevational view of a frame for the backpack of FIG. 1 according to an illustrated embodiment of the present invention.

FIG. 1 shows a backpack 100 having a load compartment 102 coupled to a shoulder harness 104 and a waist belt 106. In the illustrated embodiment, the backpack includes a back pad 108 coupled to vertically oriented side bolsters 110, which are retained in vertically oriented breathable sleeves 111. The load compartment 102 structurally couples to a frame 112 (FIG. 2). The backpack may further include a carrying handle 114, compression straps 116, and other accessory items that may take the form of webbing, straps, clips, zippers, pads, etc.

FIG. 2 shows the frame 112 that may be used to support the load compartment 102 according to an illustrated embodiment of the invention. The frame 112 includes flexible, yet sufficiently rigid vertically oriented stays 118 received in stitched pockets 120 of a soft covering 122. In one embodiment, the frame 112 may include a semi-rigid back plate 124 located in a lower stitched pocket 126. Further, the frame may include horizontally oriented stays 128, which may be structurally coupled or integrally formed with the vertically oriented stays 118. In the illustrated embodiment, the frame 112 is connected to the waist belt 106 and further includes connection devices 130 for coupling to the load compartment 102.

The illustrated frame 112 is commonly referred to as a "soft-frame" because the stays are flexible enough to form and generally move with the wearer, yet structurally strong and stiff enough to support the load compartment 102, shoulder harness 104, and waist belt 106 even when the load compartment 102 contains a substantial amount of weight, for example more than thirty pounds (30 lbs.). The length, width, thickness, and material of the stays 118, 128 may be selected depending on a desired purpose of the backpack 100.

Figure 3:
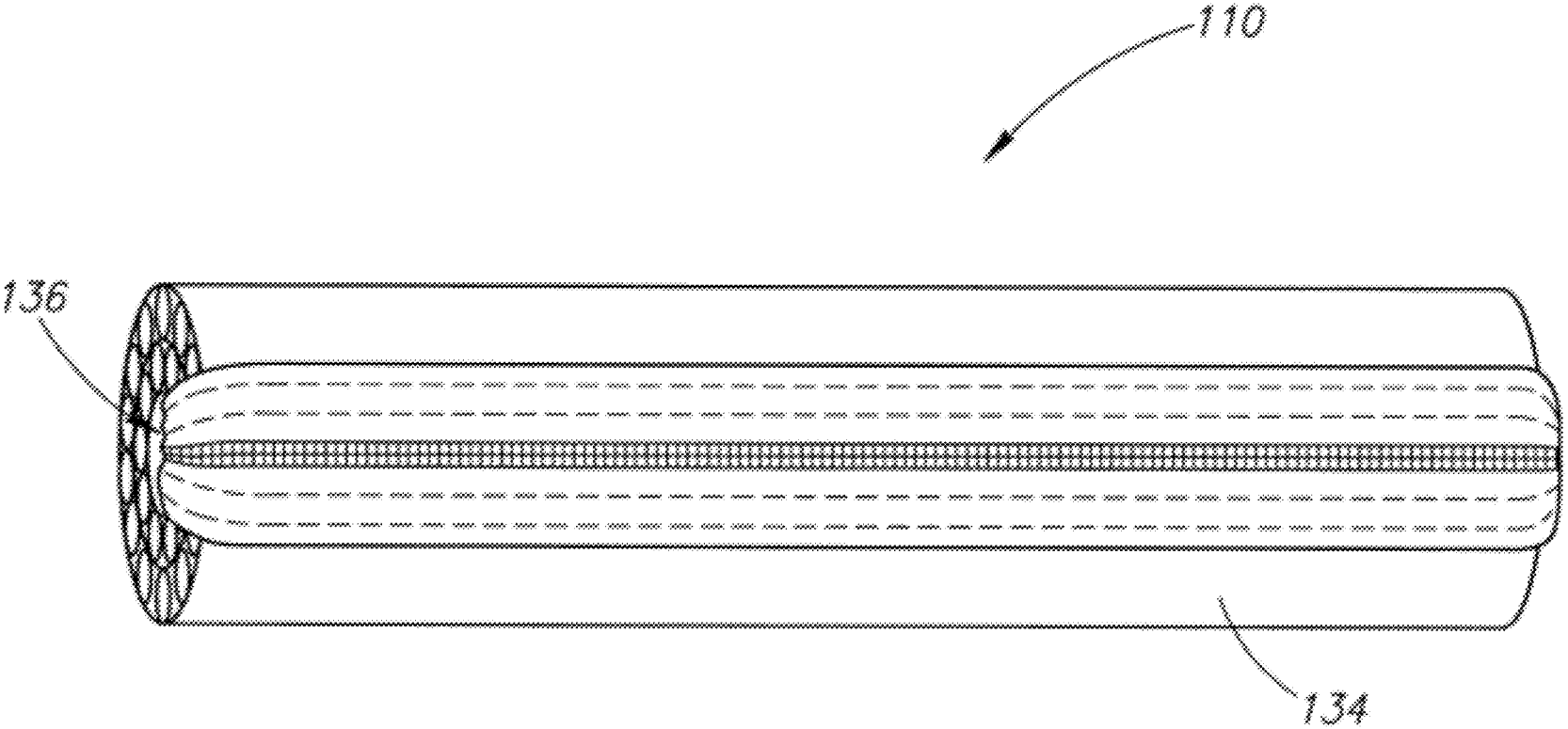
FIG. 3 is a isometric view of a side bolster in a rolled configuration according to an illustrated embodiment of the present invention.

FIGS. 3-5 shows the side bolster 110 in both a rolled configuration (FIGS. 1 and 3) and in an unrolled configuration (FIG. 2) according to an illustrated embodiment of the present invention. When placed in the breathable sleeves 111 (FIG. 1) of the backpack 100 (FIG. 1), the side bolster 110 would be in the rolled configuration. The rolled configuration permits the side bolster 110 to have a desired amount of bending stiffness, buckling strength, and structural stability for the purpose of cooperating with the frame 112 (FIG. 2) and helping to stabilize the load compartment 102 (FIG. 1) of the backpack 100 (FIG. 1). Another purpose of the side bolster 110 is to offset or space the backpack 100 away from the back of the wearer. In one application, the side bolsters 100 have been found to be advantageous on military-style backpacks to stabilize the backpack 100 while maintaining the backpack 100 away from or nested and contoured with an armored plate (not shown) worn on the backside of a soldier (not shown). As will be described in greater detail below, the side bolster 110 may be radially compressible, yet remain breathable to provide ventilation and have a cross-sectional stiffness that helps stabilize the backpack 100 with respect to the wearer.

In one embodiment, a first side portion 132 is coupled to a mid portion 134 of the side bolster 110. By way of example, the first side portion 132 may be coupled to the mid portion 134 with a fastening system 136, for example a zipper device, a hook and loop fastening system (e.g., VELCRO®), an adhesive or bonding agent, or an equivalent system. However, the side bolster 110 does not have to be coupled together with the fastening system 136 to hold its rolled configuration because the side bolster 110 may be rolled and then placed into the breathable sleeve 111 (FIG. 1). In turn, the sleeve 111 is sized to maintain the side bolster 110 substantially in the rolled configuration.

Figures 4A, 4B:
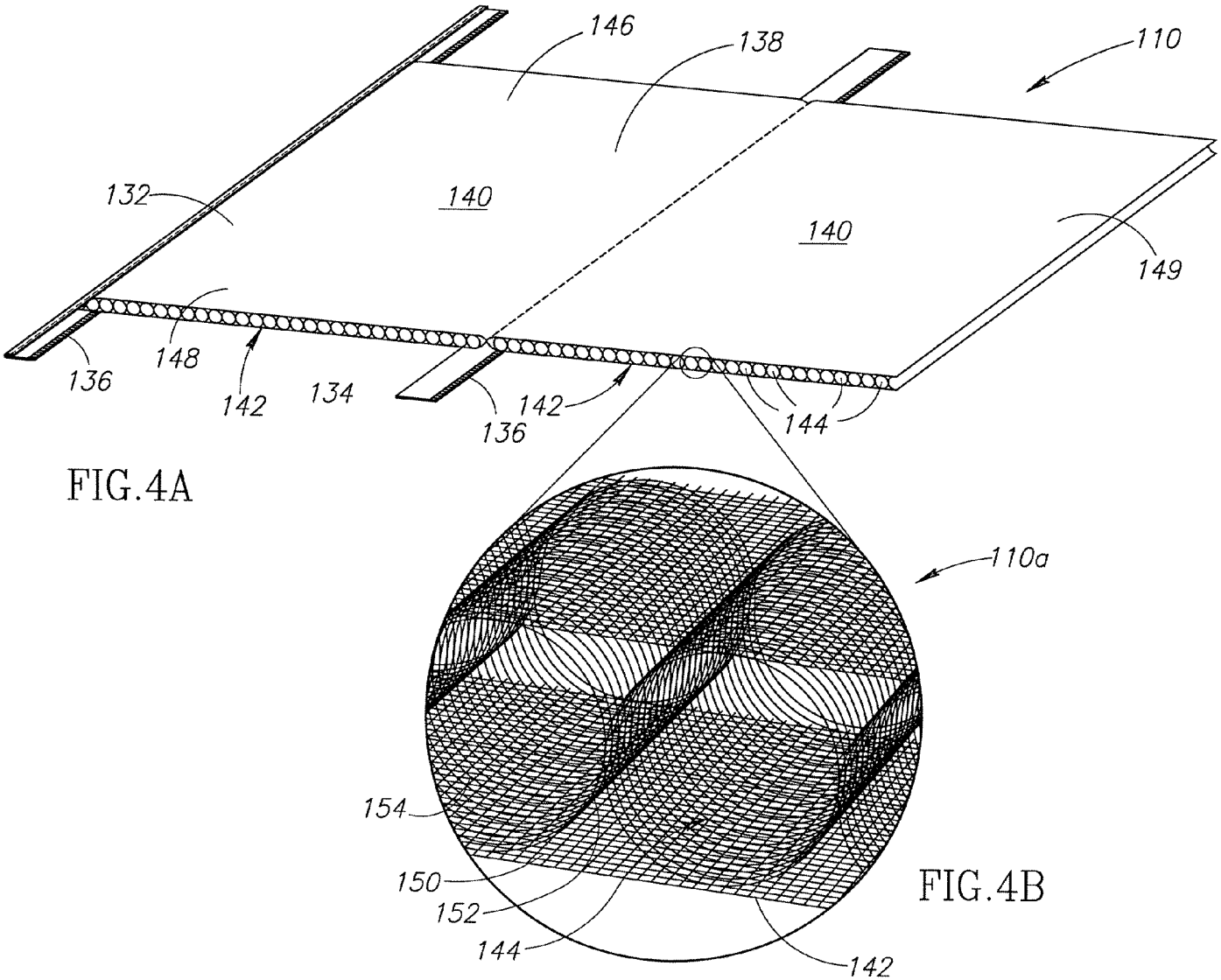
FIG. 4A is a isometric view of a side bolster in an un-rolled configuration according to an illustrated embodiment of the present invention.
FIG. 4B is a close-up view of a portion of the side bolster of FIG. 4A.

Referring to FIG. 4A, the side bolster 110 may be made from a woven, synthetic material 138 that when rolled and/or radially compressed still allows for airflow through the material 138. By way of example, the side bolster 110 is made from a woven, polypropylene or polyethylene fabric or an open-celled foam having a first surface 140 spaced apart from a second surface 142 by a plurality of woven channels 144. Each channel 144 extends from a bottom end portion 146 to a top end portion 148 of the material 138. The material 138 may be a woven geotextile polypropylene fabric commercially available under the trademark PROPEX®. In the illustrated embodiment, the side bolster 110 includes a generally circular cross-section, but it is appreciated that the cross-sectional profile of the side bolster 110 may take a variety of forms or shapes. For purposes of clarity, the structural details of the side bolster 110 are shown in FIG. 4B. Although FIG. 4A is shown with the side bolster 110 in an un-rolled configuration for purposes of clarity, it is appreciated that the side bolster 110 may be completed by rolling a second side portion 149 towards the first side portion 132 and then either inserting directly into the breathable sleeve 111 (FIG. 1) or using the fastening system 136 to maintain the side bolster 110 in the rolled configuration.

FIG. 4B shows a close-up view of a portion 110*a* of the side bolster 110 of FIG. 4A. In one embodiment, the side bolster 110 is a porous, mesh or breathable material 138 having a plurality of holes or openings 150. In addition, the material 152 defining the channels 144 is made from the same porous, mesh or breathable material 138 and includes a plurality of holes or openings 154.

Figure 5A:
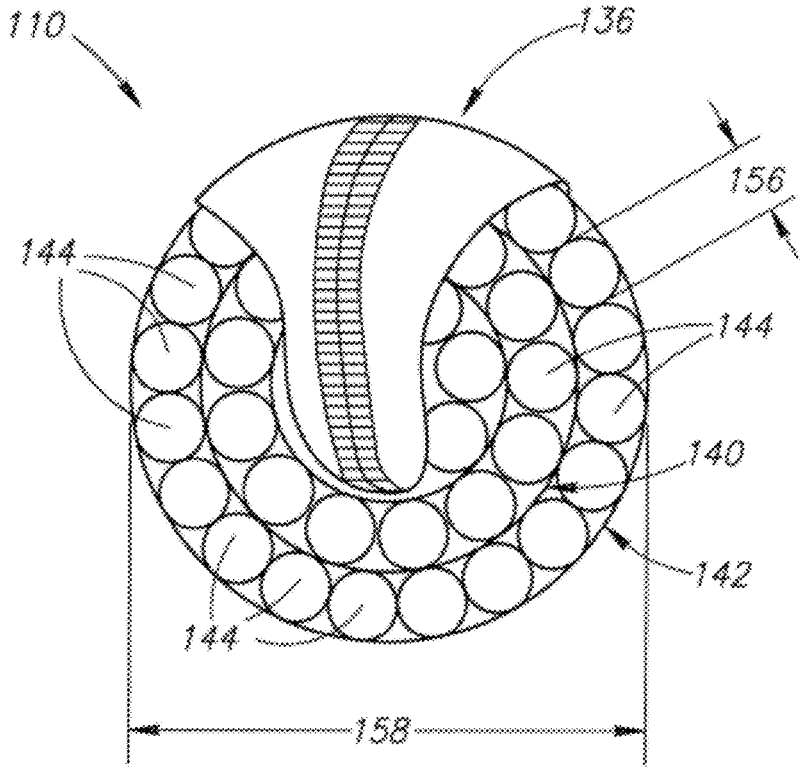
FIG. 5A is a top view of the side bolster of FIG. 3.

FIG. 5A shows the side bolster 110 in the rolled configuration and being held in that configuration by the fastening system 136 according to an illustrated embodiment of the present invention. Many aspects of the side bolster 110 may be varied to customize the side bolster 110 for a particular purpose. By way of example, the type of material 138, 152 may have more or less stiffness than the materials described above, have a greater density or porosity (e.g., larger openings 150, 154), the channels 144 may be have a larger or smaller diameter 156 or may even have different size diameters (e.g., a first channel diameter size in one portion of the side bolster and a second channel diameter size in another portion of the side bolster), and an overall diameter 158 of the side bolster 110 may be changed to effect the stiffness, breathability, or both of the side bolster 110.

Figure 5B:
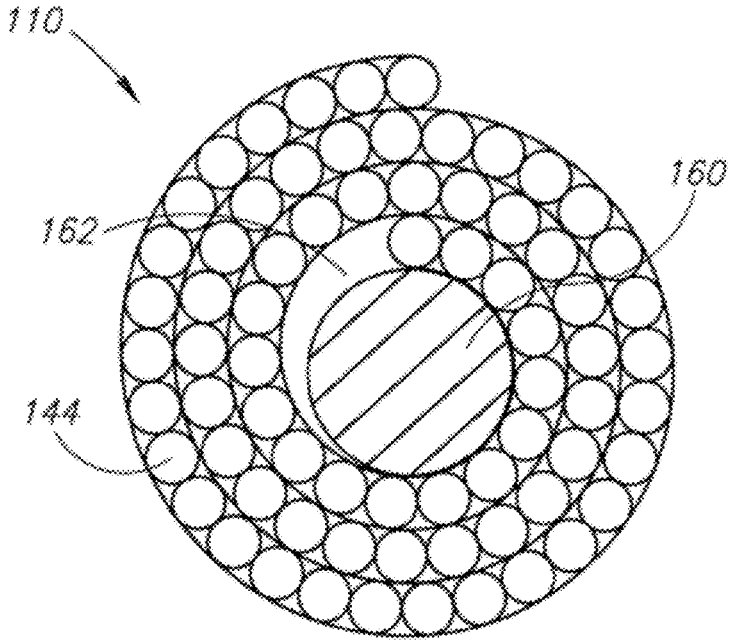
FIG. 5B is a top view of a side bolster having a spacer according to another illustrated embodiment of the present invention.

FIG. 5B shows the side bolster 110 in the rolled configuration, without the fastening system 136, and having an spacer or internal support rod 160 according to an illustrated embodiment of the present invention. The spacer 160 may take the form of an anti-buckling rod or stiffness enhancing rod, for example. The spacer 160 may be rolled up into the side bolster 110 or inserted through a central channel 162 after it has been rolled up.

Side bolsters 110 may alternatively be constructed of other materials. Closed or open cell materials may be used, including rubber or foam. The density can be selected based on the load to be carried. The stiffness may vary based on the selection of the bolster material as well. The material may be rolled from a sheet form, as discussed above, or may be one or more blocks of material stacked together vertically or otherwise. The material may be progressively more dense or stiff as it extends away from the back of the user or may vary vertically in compressibility. Various materials and material arrangements may be employed to meet the needs of the load and the user.

Briefly referring back to FIG. 1, the side bolsters 110 are received in elongated, breathable sleeves 111. The sleeves 111 may extend vertically over a substantial portion of the backpack 100 or may be truncated to have a shorter height, for example a height approximately equivalent to a height of the waist belt 106. Further, the sleeves 111 may take the form of a plurality of sleeves vertically aligned with one another and extending over the substantial portion of the backpack 100 or may be arranged in other configurations on the backpack 100. In one embodiment, the sleeves 111 are made from a woven fabric in which the selected weave pattern permits a substantial amount of airflow through the sleeves 111.

Figure 6:
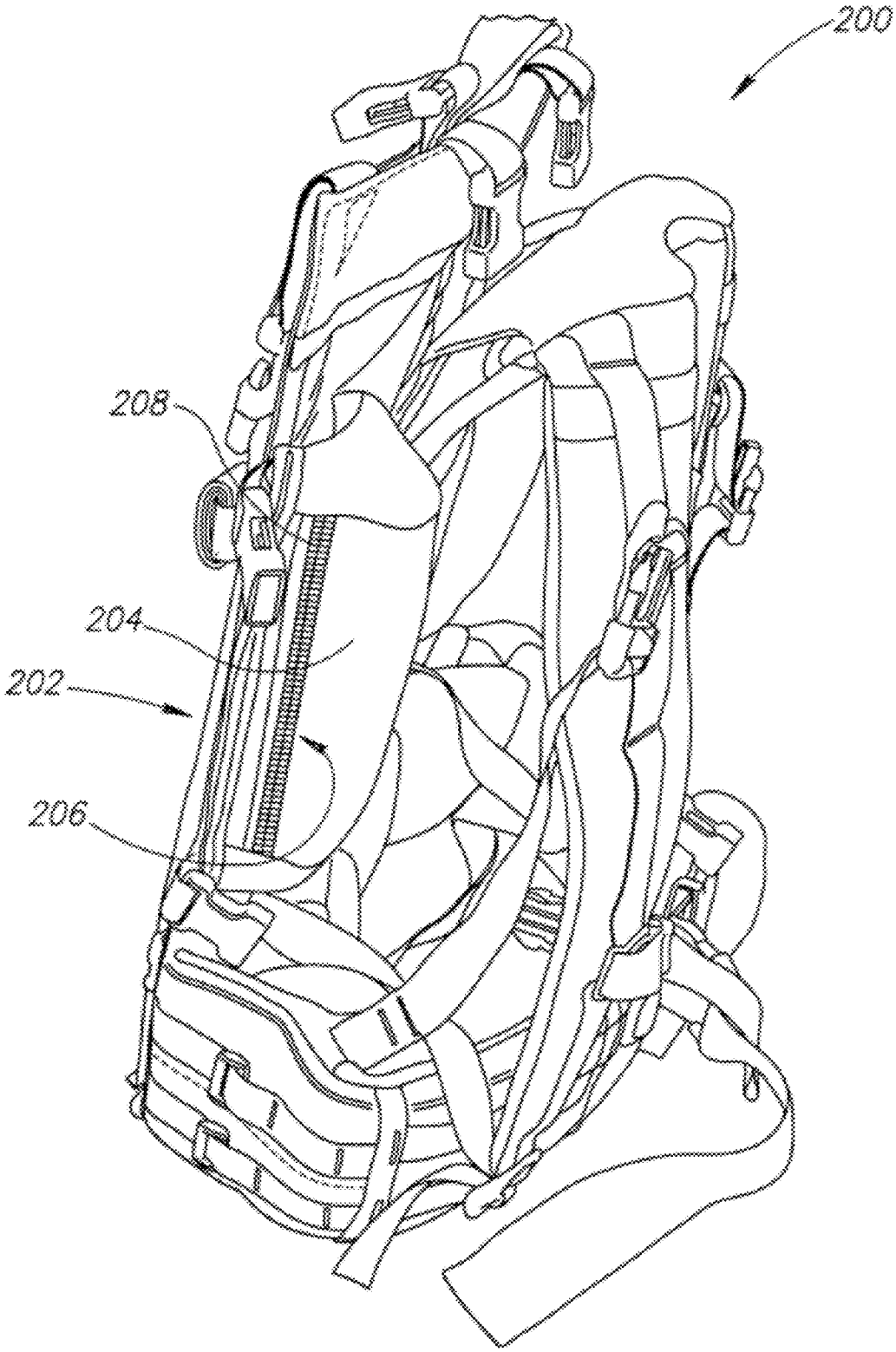
FIG. 6 is a side perspective view of a backpack having a side bolster assembly according to another illustrated embodiment of the present invention.

FIG. 6 shows a backpack 200 coupled to a bolstered ventilation and stabilization system 202 according to an illustrated embodiment of the present invention. The bolstered ventilation and stabilization system 202 includes side bolsters (not shown), such as the side bolster 110 described above, received in breathable sleeves 204. The breathable sleeve 204 includes an access system 206 for gaining access to inside the sleeve 204 and specifically for gaining access to the side bolster (not shown). In the illustrated embodiment, the access system 206 takes the form of a side zipper 208 extending along at least a substantial length of the sleeve 204. However, the access system 206 may take other forms such as a top flap, top or bottom zipper, an internal zipper accessible from within the backpack 200, or other equivalent embodiments.

The backpack with side bolsters according to any of the embodiments described above may advantageously improve or enhance ventilation to the wearer's backside and may advantageously cooperate with the frame to increase the stability of the load compartment of the backpack. In addition, the side bolsters may be arranged to replace rigid plastic extension members located near the hip belts on some backpacks. The rigid plastic extension members are sometimes used to create some space between the wearer's backside and the backpack.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined by reference to the claims that follow.

The embodiments of the invention in which an exclusive property or privilege is claimed are defined as follows:

1. A backpack comprising:

a frame, the frame having a substantially vertical forward surface with two lateral sides, whereby the forward surface is provided to rest against the backside of a wearer;

a load compartment coupled to the frame rearward of the forward surface;

shoulder straps coupled to the frame;

at least two sleeves coupled to the load compartment, the sleeves made from a breathable material, the sleeves being on either lateral side of the forward surface; and at least two side bolsters both configurable into cylindrically-shaped, rolled members receivable within the sleeves, the side bolsters are made from another breathable material that cooperates with the breathable material of the sleeves to allow air flow through both the sleeves and the side bolsters, the side bolsters having rolled axes oriented substantially vertically to structurally cooperate with the frame in providing stability for the load compartment;

wherein the rolled axes of the side bolsters are spatially separated in a forward direction from the forward surface of the frame, whereby the side bolsters are provided to contour around the backside of the wearer to provide stability for the load compartment and ventilation.

2. The backpack of claim 1, further comprising:

access mechanisms coupled to the sleeves, the access mechanisms having an open position and a closed position, wherein the cylindrically-shaped, rolled members are accessible when the access mechanisms are in the open position.

3. The backpack of claim 2, wherein the access mechanisms are zippers.

4. The backpack of claim 1, wherein the breathable material of the side bolsters is a woven, synthetic material forming a plurality of channels, each channel located between a first woven surface and a second woven surface.

5. The backpack of claim 4, wherein each channel includes a substantially circular cross-section.

6. The backpack of claim 1, wherein the side bolsters are maintained in the cylindrical shapes with meshably engageable zippers coupled to end portions and mid portions, respectively, of the side bolsters.

7. The backpack of claim 1, wherein the frame includes a plurality of flexible frame stays.

8. The backpack of claim 1, further comprising:

a small diameter rod positioned within the cylindrically-shaped, rolled members to provide additional stability along with that of the side bolsters and frame.

9. The backpack of claim 1, wherein one side bolster includes at least two cylindrically-shaped, rolled members each having different stiffnesses.

10. The backpack of claim 9, wherein one side bolster includes at least two cylindrically-shaped, rolled members each having different geometric configurations.

11. A stabilizing system for a backpack, the stabilizing system comprising:

a back pad coupled to the backpack, the back pad having a surface oriented substantially vertical, whereby the surface is provided to rest against the backside of a wearer;

a pair of rolled members each made from a woven synthetic material;

a pair of sleeves coupled to the back pad and sized to receive the cylindrically-shaped, rolled members, the sleeves horizontally spaced apart from each other by approximately a width of the back pad and the sleeves oriented approximately vertically, the sleeves made from a breathable material, the cylindrically-shaped, rolled members are respectively arranged in the sleeves to provide an amount of structural stabilization to the backpack, the cylindrically-shaped, rolled members cooperate with the sleeves to move air along the back pad within the spaced apart region formed by the sleeves; and wherein the rolled members have rolled axes oriented substantially vertically to structurally cooperate with the backpack in providing stability for the backpack, wherein the rolled axes of the rolled members are spatially separated in a forward direction from the surface of the back pad, whereby the rolled members, in combination with the back pad, contour around the backside of the wearer to provide stability for the backpack and to provide ventilation.

12. The stabilizing system of claim 11, wherein the sleeves included a zipper for opening the sleeve to access the cylindrically-shaped, rolled members.

13. The stabilizing system of claim 11, wherein the cylindrically-shaped, rolled members are maintained in a cylindrical shape with a first zipper coupled to an end portion of the members and a second zipper coupled to a mid portion of the members, the first zipper meshably engageable with the second zipper after the members are rolled.

14. The stabilizing system of claim 11, wherein the cylindrically-shaped, rolled members have adjustable stiffnesses.

15. The stabilizing system of claim 11, further comprising:

a support member positioned within at least one of the cylindrically-shaped, rolled members to provide an amount of vertical bending stiffness.

16. The stabilizing system of claim 15, wherein the support member increases a buckling strength of the cylindrically-shaped, rolled member.

17. The stabilizing system of claim 11, wherein the cylindrically-shaped, rolled members each have a plurality of channels located between a first woven surface and a second woven surface.

18. The stabilizing system of claim 11, wherein each of the cylindrically-shaped, rolled members includes a plurality of open cells located between a first woven surface and a second woven surface.

* * * * *